US006305679B1

(12) United States Patent
Brill

(10) Patent No.: US 6,305,679 B1
(45) Date of Patent: Oct. 23, 2001

(54) SKI AND SNOWBOARD SUPPORTING STAND AND METHOD OF EMPLOYING SAME

(76) Inventor: Donald James Brill, 1815 Gravers La., Wilmington, DE (US) 19810

( * ) Notice: Subject to any disclaimer, the term of this patent is extended or adjusted under 35 U.S.C. 154(b) by 0 days.

(21) Appl. No.: 09/552,000

(22) Filed: Apr. 19, 2000

(51) Int. Cl.[7] ..... B23Q 3/02

(52) U.S. Cl. ..... 269/133; 269/234; 269/274; 269/296; 269/906

(58) Field of Search ..... 269/133, 234, 269/274, 296, 43, 906

(56) References Cited

U.S. PATENT DOCUMENTS

| | | | | |
|---|---|---|---|---|
| 620,495 | | 2/1899 | Ramseaur . | |
| 744,550 | | 1/1903 | Kendrick . | |
| 2,625,861 | | 1/1953 | Swanson . | |
| 2,667,799 | | 2/1954 | Rzepela . | |
| 3,719,008 | | 3/1973 | Mayers . | |
| 3,977,663 | | 8/1976 | Köhler et al. . | |
| 4,049,253 | | 9/1977 | Mandel . | |
| 4,669,713 | | 6/1987 | Armantrout et al. . | |
| 4,804,171 | | 2/1989 | Dornfeld . | |
| 5,513,837 | * | 5/1996 | Osborn | 269/906 |
| 5,718,420 | | 2/1998 | Bernstein . | |
| 5,848,783 | * | 12/1998 | Weissenborn | 269/906 |
| 5,871,098 | | 2/1999 | Storck . | |
| 5,893,550 | * | 4/1999 | Lassley | 269/906 |
| 6,019,357 | | 2/2000 | Bartsch . | |
| 6,019,358 | | 2/2000 | Bernstein . | |
| 6,244,581 | * | 6/2001 | Arnhold | 269/234 |

* cited by examiner

*Primary Examiner*—Robert C. Watson

(57) ABSTRACT

A portable stand for holding snowboards and skis horizontal and upright during servicing, comprising two identical and free standing stations. Each station having one horizontal member having two temporarily connected support legs. The top surface of the horizontal member and the bottom surface of the support legs are covered with an anti-slip material. A two sided angular slot is centrally located along the top surface of the horizontal member for receiving an upright, base vertical, snowboard or ski for side edge servicing. The depth of the angular slot being approximately equal to one half the width of the widest portion of a typical ski and having a vertical wall and an inclined wall. A wedge dimensioned to mate with the angular slot rests within the angular slot and a means for securing the wedge within the angular slot is provided. The angular slot and wedge are sized to receive the snowboard and ski individually when either is positioned uprightly between the vertical wall of the angular slot and vertical wall of the wedge. A method for employing the angular slot, the wedge and the means for securing the wedge within the slot for firmly holding both the snowboard and the ski individually upright within the angular slot also forms part of the present invention.

7 Claims, 4 Drawing Sheets

SKI AND SNOWBOARD SUPPORTING STAND AND METHOD OF EMPLOYING SAME

BACKGROUND OF THE INVENTION

1. Field of the Invention

This invention relates generally to stands for supporting skis and snowboards while either is being tuned. More specifically, this invention is a stand which holds skis and snowboards horizontal during base preparation and upright during side edge servicing.

2. Prior Art

Skis and snowboards are tuned regularly by many users, which includes sharpening the metal edges and preparing the plastic base for better glide over snow. Holding a ski during the tuning process has become more difficult in the past few years because of performance enhancing changes. Most skis now have angled side walls and uneven top surfaces. Snowboarding has also become a common winter pastime at mountain resorts. The typical ski holding vises developed in the 1970s and 1980s have been rendered nearly obsolete because of these changes in ski design and the popularization of snowboarding.

New vises and other holding systems have recently been introduced. Most of the new systems clamp onto a work table using mechanical clamps and use other clamps to hold a ski or snowboard in place. These mechanical clamping systems are generally expensive, cumbersome, and not very versatile. Recent innovations have included suction cups as described in Lassley's patent (5,893,550).

Suction cups as described in Lassley's patent have difficulty keeping a vacuum unless they are pressed onto a very smooth and clean surface, conditions which are uncommon around ski and snowboard tuning areas. For base preparation, the top surface of a ski or snowboard is pressed onto upper suction cups of the Lassley's stand. The top surface of the ski or snowboard contacting the suction pad can not have any sizable scratches, any irregularities, and must be flat or the vacuum within the cup will be lost. As mentioned earlier, ski tops are typically no longer flat. Armantrout's patent (4,669,713) describes friction pads instead of suction cups on a rather large, non-portable, heavy, and fixed frame jig for supporting skis while they are resting horizontally for base preparation.

Lassley's and Armantrout's patents both incorporate a fixed vertical slot in an attempt to hold a ski in an upright position for sharpening of the side of the metal edge of a ski. Lassley also attempts to uprightly support snowboards as well as skis.

Because snowboards are three times as wide as skis, it is difficult to provide a slot which firmly holds a snowboard upright and is not so deep as to hinder the side edge filing of a ski placed upright in the same vertical slot. Another area of concern is the large difference in ski and snowboard thickness. Skis become much thicker at their midsection while snowboards change very little, if at all, from one end to the other. Therefore, fixed width slots within ski and snowboard holding fixtures do not adequately hold skis and snowboards upright for convenient side edge servicing.

As snowboarding has become popular and skis have changed shape dramatically there is a need for a ski and snowboard stand which can rest on different types of surfaces such as tables and carpeting, is readily portable, inexpensive, and can easily hold both skis and snowboards horizontal and upright during the tuning process.

SUMMARY OF THE PRESENT INVENTION

The present invention solves the prior art problems by providing a portable ski and snowboard stand which is easy to use, rests on any solid surface, can support a ski and snowboard horizontally, and also firmly holds them upright within a provided angular slot.

The present invention comprises a stand having two independent stations. Each station having a horizontal cross member and two trapezoidal legs extending perpendicularly in relationship to the cross member. The bottom surfaces of the legs are covered with anti-slip pads for holding each station in place where it rests and anti-slip pads also cover the top surface of each cross member on which a ski or snowboard rests during base preparation, thus limiting horizontal movement of the horizontally positioned ski or snowboard. Each station contains an angular slot in the top surface of the horizontal cross member, a wedge, and a stretched elastic band which firmly hold a ski and a snowboard upright while either is having a side edge shaped.

The primary object of the present invention is to provide a stand for securely holding a ski or snowboard in both a horizontal and upright position during the tuning process.

Another object of the invention is to provide a very light-weight, inexpensive, and portable stand which can be used on most solid surfaces.

A further object is to provide a method for employing the combination of an angular slot, a wedge, and an elastic band of the invention for holding a ski and snowboard upright during the tuning process. The slot having a depth of approximately one half the width of the tip and tail of a typical ski.

These objects and other features of the present invention will be apparent from the following description and accompanying drawings.

DETAILED DESCRIPTION OF THE PREFERRED EMBODIMENT

Figure 1:
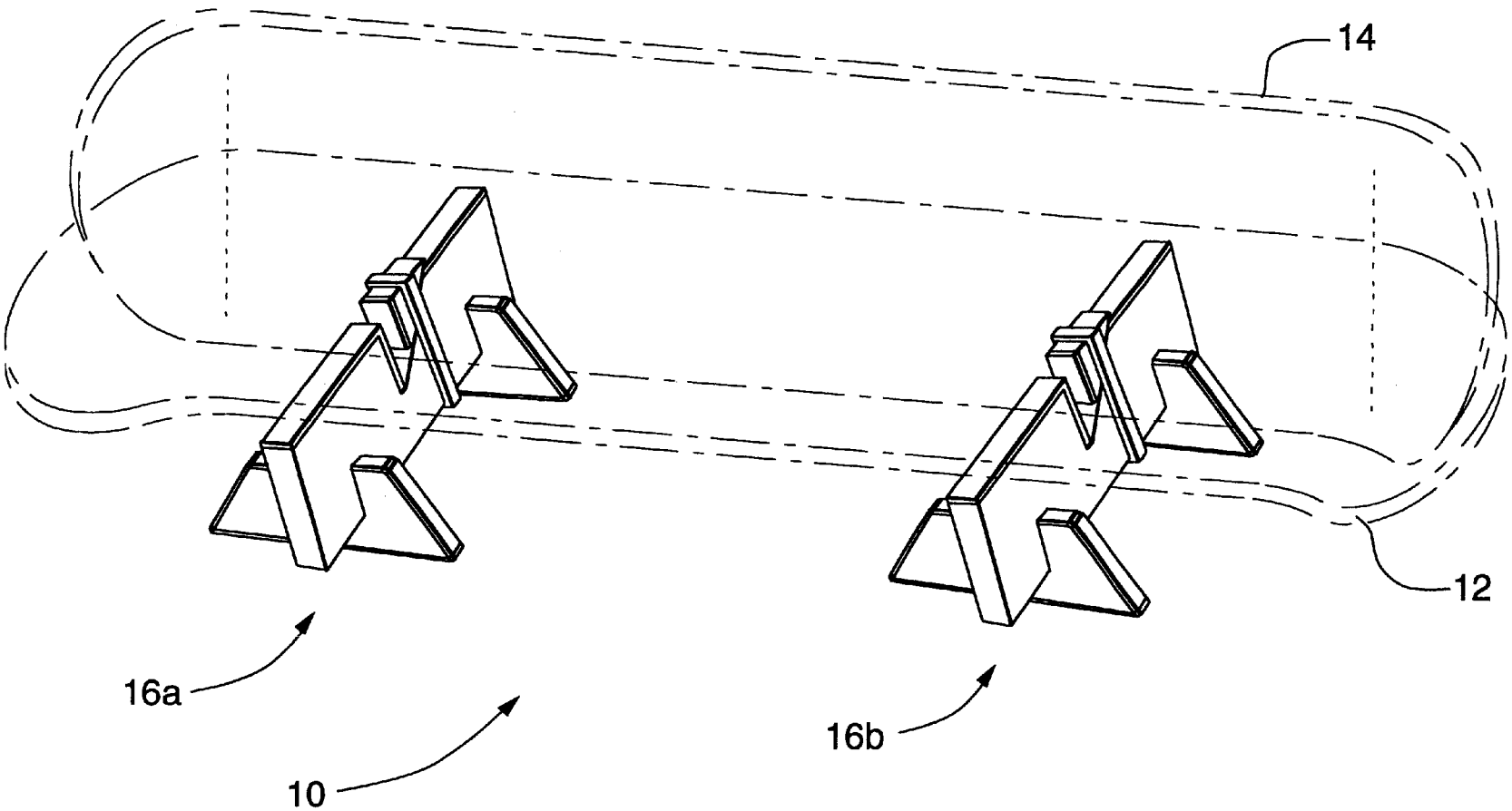
FIG. 1 is a perspective view of the present invention holding snowboards in a horizontal and upright position.

Referring to FIGS. 1–4 of the present embodiment. FIG. 1 is a perspective view of a ski and snowboard stand 10 of the present invention supporting a horizontal snowboard 12 and a upright snowboard 14. The stand 10 mainly comprises two identical, independent, and free standing support stations 16*a* and 16*b*.

Figure 2:
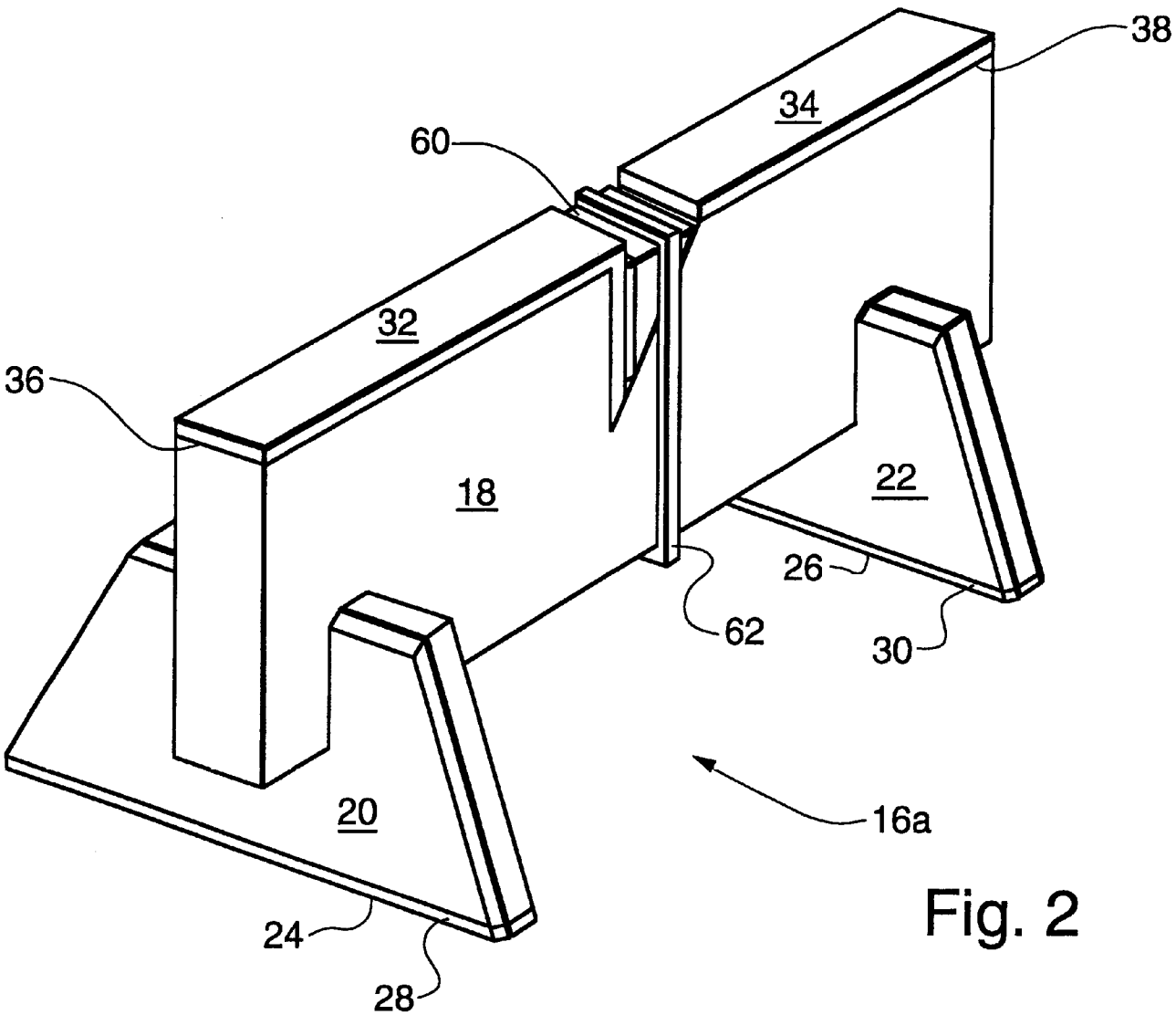
FIG. 2 is a perspective view of a station of the present invention.

The station 16*a* is better shown in the perspective view of FIG. 2. The station 16*a* is one of the two identical stations 16*a* and 16*b* and therefore only the station 16*a* need be described in detail here with the understanding that the features of station 16*a* apply to station 16*b*. FIG. 2 shows the station 16*a* assembled. A horizontal member 18 of the station 16*a* is supported by two identical trapezoid shaped legs 20 and 22. A bottom surface 24 of the leg 20 is covered with an anti-slip material 28. A bottom surface 26 of the leg 22 is also covered with an anti-slip material 30. Anti-slip pads 32 and 34 cover top surfaces 36 and 38 of the horizontal member 18. During base preparation, the anti-slip material 28 and 30 on the bottoms 24 and 26 of the legs 20 and 22 resist all sliding of the station 16*a* across a surface on which the station 16*a* rests and the anti-slip pads 32 and 34 resist all horizontal sliding across the horizontal member 18 of the horizontally positioned snowboard 12. During base preparation an operator uses both a downward and a longitudinal force. The downward force presses the horizontal snowboard 12 tightly against the anti-slip pads 32 and 34 which help the anti-slip pads 32 and 34 frictionally resist all sliding of the horizontal snowboard 12. The anti-slip material of the preferred embodiment is expanded neoprene.

Figure 3:
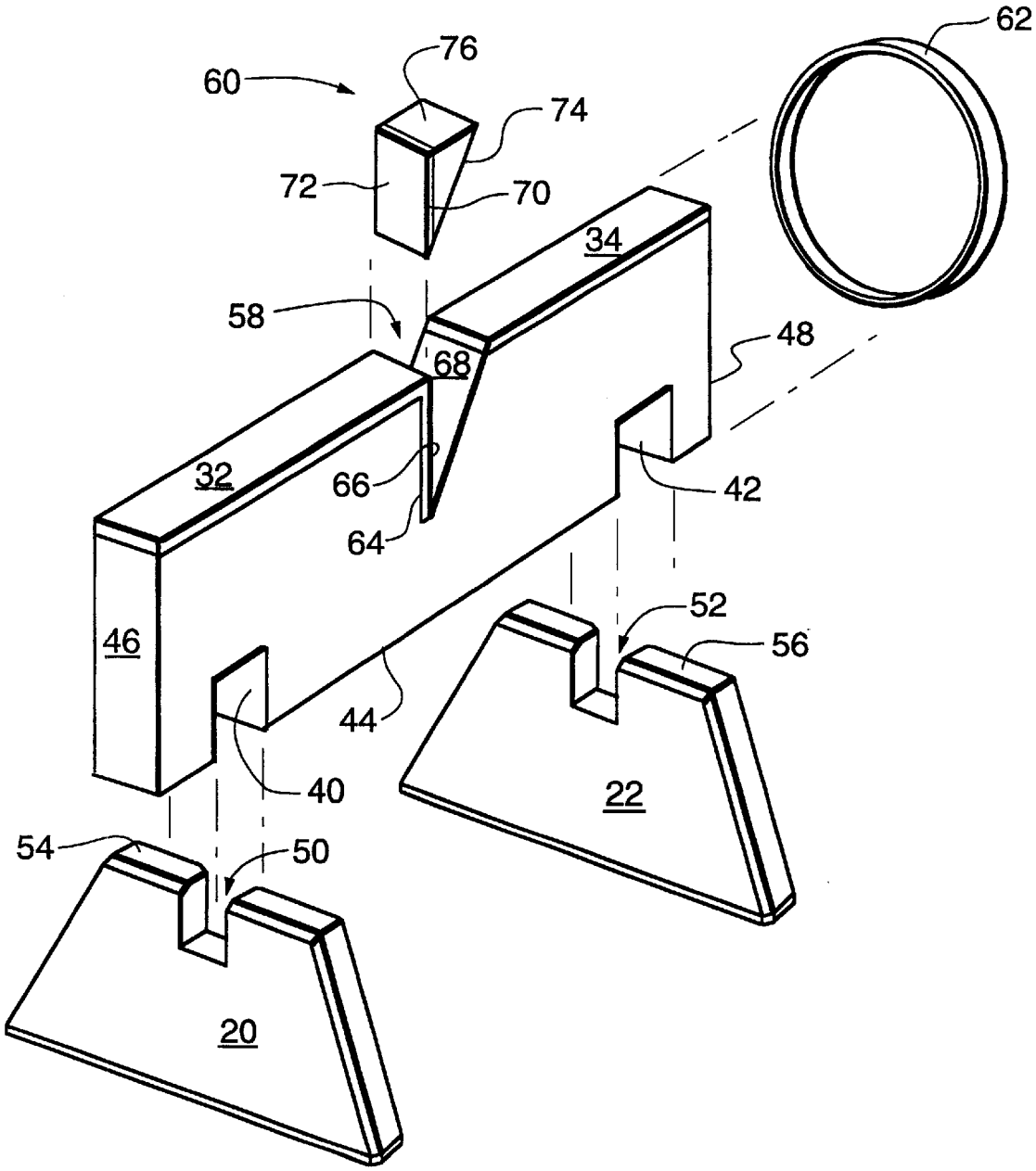
FIG. 3 is an exploded perspective view of one of the stations of the present invention.

The various components of the station 16*a* are illustrated in the exploded perspective view of FIG. 3. Two open ended rectangular slots 40 and 42 are located along a bottom 44 and towards each end 46 and 48 of the horizontal member 18. The widths of the slots 40 and 42 equal the thickness of the legs 20 and 22. The legs 20 and 22 also have open ended rectangular slots 50 and 52 centrally located along top surfaces 54 and 56, whose widths equal the thickness of the horizontal member 18. To temporarily join the legs 20 and 22 with the horizontal member 18, the slots 50 and 52 are aligned with the respective slots 40 and 42 of horizontal member 18. The legs 20 and 22 and the horizontal member 18 are then pressed together. The preferred material of construction for both the legs 20 and 22 and the horizontal member 18 is wood but plastic can also be used. These two materials compress, which allow a tight pressed fit and they recover dimensionally when the legs 20 and 22 are separated from the horizontal member 18 during storage and travel of the stand 10.

Figure 4:
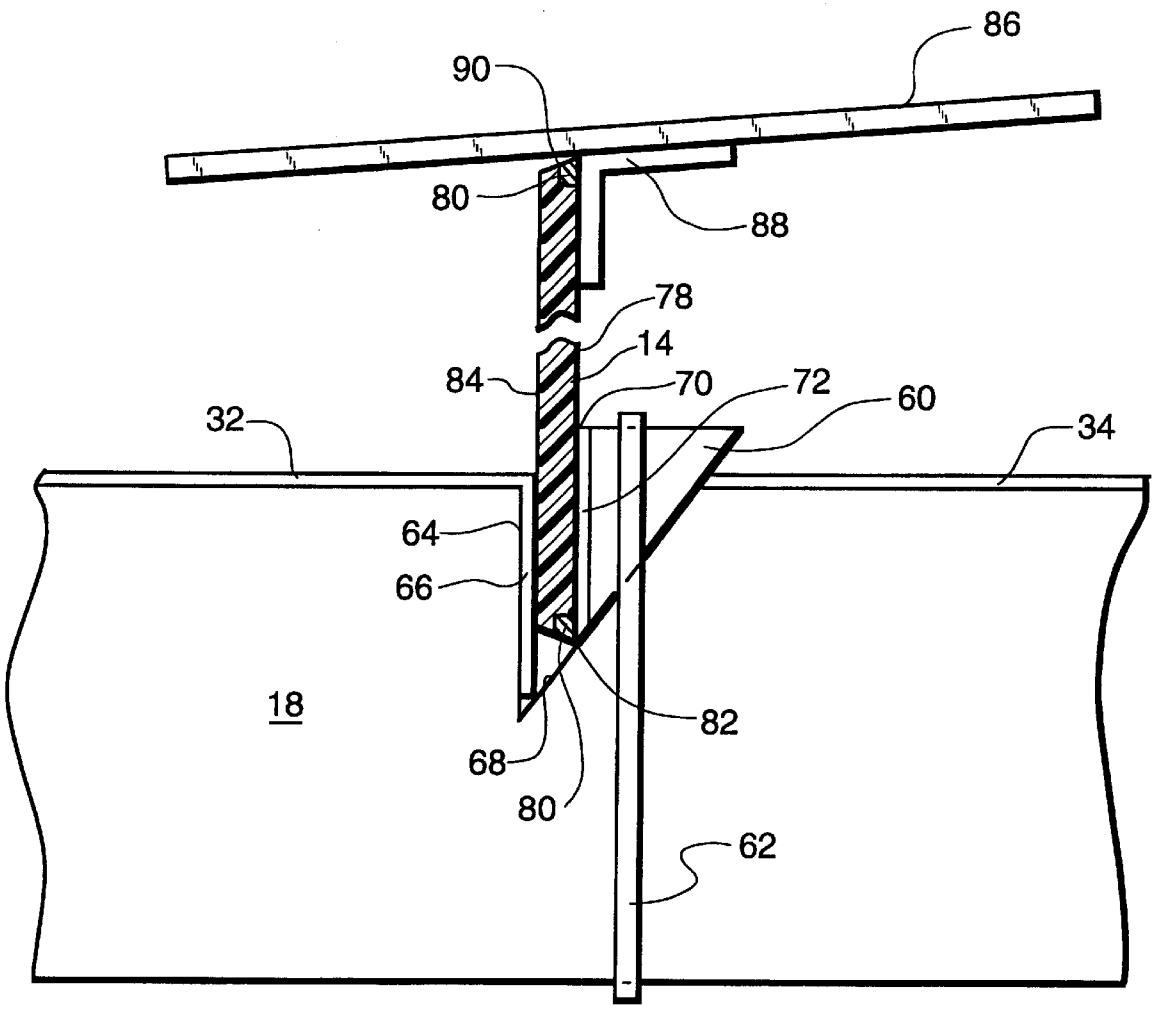
FIG. 4 is fragmentary plan view of one of the stations of the present invention, an end plan view of a file guide, a side plan view of a file, and a fragmentary sectional view of the upright snowboard.

A novel combination of an angular slot 58, a wedge 60, and an elastic band 62 for firmly holding the upright snowboard 14 in place during side edge shaping is best shown in FIGS. 3 and 4. The open ended, angular slot 58 is centrally located between the top surfaces 36 and 38 of the horizontal member 18. The angular slot 58 has a vertical side wall 64 covered with an anti-slip material 66 and an inclined wall 68. The solid wedge 60 has a vertical wall 70 covered also with an anti-slip material 72, an inclined wall 74 and a horizontal wall 76. The included angle between the vertical wall 70 and the inclined wall 74 of the wedge 60 is equal to the included angle between the vertical wall 64 and the inclined wall 68 of the slot 58. The length of the vertical wall 70 of the wedge 60 is less than the length of the vertical wall 64 of the slot 58. When the wedge 60 is within the slot 58 without the upright snowboard 14 between the anti-slip material 66 and 72, the horizontal wall 76 of the wedge 60 is below the plane of the anti-slip pads 32 and 34 of the horizontal member 18.

Referring for the most part to FIG. 4, a continuous metal edge 80 surrounds a base 78 of the upright snowboard 14. The metal edge 80 has a sharp corner 82 for gripping snow and ice during a turn while snowboarding. Skis, not shown here, also have a metal edge similar to the snowboards 12 and 14. With the upright snowboard 14 in the slot 58, the sharp corner 82 of the metal edge 80 rests on, and slightly cuts into, the inclined wall 68 of the slot 58. The upright snowboard 14 has a top surface 84 which contacts the anti-slip material 66 of the slot 58. With the wedge 60 also within the slot 58, the anti-slip material 72 of the wedge 60 presses against the base 78 of the upright snowboard 14. The elastic band 62, stretched, vertically encircles the wedge 60 and the horizontal member 18. The compressive force of the elastic band 62 causes the wedge 60 to slide down the inclined wall 68 which in turn actively presses the anti-slip pad 72 of the wedge 60 against the base 78 of the upright snowboard 14. This force is then transferred to the upright snowboard 14 causing the top surface 84 of the upright snowboard 14 to actively press against the anti-slip material 66 of the vertical wall 64 of the slot 60. The anti-slip material 66 and 72 frictionally resist movement of the upright snowboard 14 during side edge shaping.

Again referring to FIG. 4, a file 86 is shown in position on an angular file guide 88 and is contacting a side surface 90 of the metal edge 80. This is a typical configuration for filing the side surface 90 of the metal edge 80 of the upright snowboard 14. During the side surface 90 shaping process, the file 86 and the angular guide 88 are moved in unison lengthwise along the edge 80 of the upright snowboard 14. The file 86 is pressed down against the side surface 90 of the metal edge 80 while the operator is filing. The file guide 88 helps to maintain the file 86 at the correct angle for generating an angled side surface 90 on the metal edge 80. During the filing operation, the operator presses the file guide 88 sideways against the base 78 of the upright snowboard 14. At first glance it appears that the wedge 60, with the force from the elastic band 62, keep the upright snowboard 14 from tipping sideways in the direction away from the file guide 88 as the operator presses the file guide 88 against the base 78. Though the wedge 60 with the force form the elastic band 62, when stretched, does provide some resistance to this sideways movement of the upright snowboard 14 within the slot 58, the majority of the resistance comes form the inability of the sharp corner 82, which readily cuts into the inclined wall 68 of the slot 58, from shaving off material from the inclined wall 68. As the operator presses against the base 78 while filing, the top surface 84 of the upright snowboard 14 within the slot 58 is pressed further against the anti-slip pad 66 and through a lever type movement of the upright snowboard 14 the sharp corner 82 of the metal edge 80 presses against the inclined wall 68 of the slot 58. The force required to shave material off the inclined wall 68 by the sharp corner 82 of the metal edge 80 is greater than the leveraged sideways force applied by the operator to the base 78 through the file guide 88, during the shaping of the side surface 90 of the metal edge 80.

The wedge 60 with the elastic band 62, when stretched, does provide enough resistance to prevent the upright snowboard 14 from gravitationally tipping sideways in the direction of the file guide 88.

Those skilled in the art will appreciate that the present invention encompasses other variations described in the preferred embodiment.

What is claimed is:

1. A portable stand for servicing snowboards and skis having two holding stations, each comprising:

a horizontal member having a top surface and a bottom surface, an angular slot centrally located along said top surface of said horizontal member, said angular slot having an open upper area, a vertical wall and an inclined wall, said angular slot being sized to receive individually said snowboard and said ski positioned uprightly;

two legs temporarily connected to said bottom surface of said horizontal member extending perpendicularly from said horizontal member;

a wedge dimensioned to mate with said angular slot of said horizontal member, having a vertical wall, a horizontal wall, and an inclined wall;

a means for securing said wedge within said angular slot; and an anti-slip material covering said top surface of said horizontal member, a bottom surface of said legs, said vertical wall of said angular slot, and said vertical wall of said wedge.

2. The portable stand of claim 1 wherein said horizontal member having longitudinally open rectangular slots along said bottom surface dimensioned to receive said legs, said legs having longitudinally open rectangular slots along a top surface dimensioned to receive said horizontal member, and said legs and said horizontal member being temporarily pressed together with said rectangular slots of said horizontal member aligned with said rectangular slots of said legs.

3. The portable stand of claim 1 wherein said anti-slip material frictionally resists movement of said snowboard and said ski.

4. The portable stand of claim 1 wherein said means for securing said wedge within said angular slot of said horizontal member comprises a stretched elastic band vertically encircling said wedge and said horizontal member.

5. The portable stand of claim 4 wherein said stretched elastic band provides a constant inward force on said wedge within said angular slot.

6. A portable stand for servicing snowboards and skis having two holding stations, each comprising:

a horizontal member having a top surface and a bottom surface, an angular slot centrally located along said top surface of said horizontal member, said angular slot having an open upper area, a vertical wall, and an inclined wall;

a wedge dimensioned to mate with said angular slot, having a vertical wall, a horizontal wall, and an inclined wall;

said angular slot and said wedge sized to receive said snowboard and said ski individually when positioned upright within said angular slot;

a means for securing said wedge within said angular slot comprising a stretched elastic band vertically encircling said wedge and said horizontal member;

two trapezoid shaped legs temporarily connected to said bottom surface of said horizontal member extending perpendicularly from said horizontal member, said trapezoid shaped legs having a top surface and a bottom surface;

and an anti-slip material covering said top surface of said horizontal member, said bottom surface of said legs, said vertical wall of said angular slot, and said vertical wall of said wedge.

7. The portable stand of claim 6 wherein said horizontal member having longitudinally open rectangular slots along said bottom surface dimensioned to receive said legs, said legs having longitudinally open rectangular slots along a top surface dimensioned to receive said horizontal member;

and said legs and said horizontal member being temporarily pressed together with said rectangular slots of said horizontal member aligned with said rectangular slots of said legs.

* * * * *